US005105059A

United States Patent [19]

Sorenson et al.

[11] Patent Number: 5,105,059

[45] Date of Patent: Apr. 14, 1992

[54] ENVIRONMENTALLY SEALED SWITCH CONSTRUCTION

[75] Inventors: Richard W. Sorenson; Milton Ives, both of Stuart, Fla.

[73] Assignee: Carlingswitch, Inc., Plainville, Conn.

[21] Appl. No.: 668,297

[22] Filed: Mar. 14, 1991

[51] Int. Cl.[5] ..... H01H 9/16; H01H 21/08

[52] U.S. Cl. ..... 200/302.3; 200/315; 200/339; 200/305; 200/295; 200/296; 200/DIG. 42; 200/437; 200/556; 200/557; 200/558

[58] Field of Search ..... 200/339, 315, 304, 437, 200/438, 553, 556, 557, 302.3, 313, 317, 305, 294, 295, 296, 303, DIG. 42

[56] References Cited

U.S. PATENT DOCUMENTS

| | | | |
|---|---|---|---|
| 4,013,857 | 3/1977 | Tanaka | 200/315 |
| 4,087,669 | 5/1978 | Sauer | 200/295 X |
| 4,121,071 | 10/1978 | Campbell et al. | 200/339 X |
| 4,218,602 | 8/1980 | Creech | 200/302.3 |
| 4,242,551 | 12/1980 | Sorenson | 200/302.3 |
| 4,268,734 | 5/1981 | Sorenson | 200/302.3 |
| 4,321,443 | 3/1982 | Piber | 200/315 |
| 4,340,791 | 7/1982 | Sorenson | 200/302.3 |
| 4,347,417 | 8/1982 | Sorenson | 200/315 X |
| 4,352,965 | 10/1982 | Sorenson | 200/339 X |
| 4,382,154 | 5/1983 | Sorenson | 200/339 X |
| 4,418,254 | 11/1983 | Busby et al. | 200/339 X |
| 4,454,400 | 6/1984 | Sorenson | 200/315 |
| 4,480,159 | 10/1984 | Kirchoff | 200/339 X |
| 4,532,393 | 7/1985 | Koizumi et al. | 200/317 X |
| 4,758,724 | 7/1988 | Osika | 200/315 |
| 4,789,766 | 12/1988 | Krause | 200/302.3 |

FOREIGN PATENT DOCUMENTS

| | | | |
|---|---|---|---|
| 1236627 | 3/1967 | Fed. Rep. of Germany | 200/302.3 |
| 1490910 | 6/1969 | Fed. Rep. of Germany | 200/315 |
| 3011184 | 10/1981 | Fed. Rep. of Germany | 200/296 |
| 2213649 | 8/1989 | United Kingdom | 200/339 |

*Primary Examiner*—Ernest G. Cusick

*Attorney, Agent, or Firm*—McCormick, Paulding & Huber

[57] ABSTRACT

A split switch case has a base and a mounting bracket fitted thereto. The top wall of the latter has a lateral rib defining sockets for receiving shoulder portions of the actuator. Plungers in the actuator can bottom out to break free the switch contacts should they fuse together. The rocker has a unique shape and is coupled to the actuator for positive pivotal movement on a lateral axis defined by surfaces in the rocker and in the mounting bracket's top wall rib. In the illuminated switch shown, the lamp circuit has at least one lead provided in a slot defined inside the mounting bracket. The lamp can be mounted in the mounting bracket either from above or from below, two depending legs will accommodate a conventional LED from either direction.

19 Claims, 4 Drawing Sheets

ENVIRONMENTALLY SEALED SWITCH CONSTRUCTION

BACKGROUND OF THE INVENTION

This invention relates generally to environmentally sealed switch case configurations. Prior U.S. Pat. Nos. 4,242,551, 4,268,734, and 4,340,791 disclose electric switch configurations wherein the chamber or cavity for the switching components or contacts is sealed to some extent. However, the switch stands well above the panel and a recess must be provided in the mounting bracket portion of the switch case with drain openings for allowing fluids to escape.

SUMMARY OF THE INVENTION

In accordance with the present invention a switch housing or case is provided in two parts, one a base having a bottom wall in which openings are provided for terminals that define fixed contacts within the case cavity. The case also has laterally spaced front and rear walls as well as opposed end walls all integrally connected to the bottom wall and to each other. At least one movable contact is provided in the switch cavity. The switch case or housing also includes a mounting bracket having a top wall and laterally spaced front and rear walls adapted to mate with the front and rear walls of the base. The bracket also has opposed end walls integrally connected to the front and rear walls thereof to define a downwardly open cavity that communicates with the cavity in the base to define the enclosed switch chamber or cavity. The mounting bracket top wall defines a raised center rib portion which in turn defines laterally spaced sockets inside the switch cavity to receive upper shoulder portions of an actuator. The actuator has at least one downwardly biased plunger slidably received in a plunger cavity of the actuator and the lower end of the plunger engages the movable contact to pivot the movable contact in response to actuator movement on a laterally extending axis defined by these actuator shoulders and associated sockets. A manually movable means preferably in the form of a rocker is provided above the mounting bracket top wall and transfers pivoting movement to the actuator by means of a rod extending into a central hole in the top of the mounting bracket generally between the shoulder receiving sockets in the rib.

In an illuminated version of the switch one or two lamps is supported in one or two openings in the mounting bracket top wall. The laterally spaced front and rear walls of the mounting bracket define downwardly open slots for receiving lamp leads, which leads would be connected to fixed terminals located on ides of the switch case opposite from the lamp, and which leads are electrically connected to said terminals by coil compression springs compressed between the terminals and lamp leads within cavities defined in part by the end walls of the switch case base and mounting bracket.

The rocker or manual means for operating the switch has a depending post provided centrally of the rocker and received in an upwardly open recess provided for said post in the actuator. Laterally spaced pivot posts are provided at opposite ends of the central rib of the mounting bracket and are received in openings provided for them in depending walls of the rocker or similar operating means, spaced inwardly of the side walls or skirts of the rocker itself. Finally, still other depending walls of the rocker are adapted to engage the upstanding rib portion of the mounting bracket to further define and strengthen the pivot for the rocker so that the rocker and actuator move on the same pivot axis in the switch case. The rocker is so designed to snap easily and securely onto the switch bracket while allowing easy removal with a simple removal tool. The easy rocker installation and removal allows later customer replacement or exchange of rockers without impairing the integrity of the switch sealing.

A snap-on connector plug to house terminal connectors may be provided. A depending orientation pin is provided on the switch base and is adapted to be received in a corresponding opening provided for this purpose in the plug. The plug also has a resiliently deformable upstanding leg with a latching ledge that is received in a notch in the switch base whereby the ledge locks behind an edge of the bracket which is secured to the switch base. The connector plug is adapted to house a variety of conventional female connectors, each of which is crimped to a wire conductor and is then nested within the connector plug so as to receive a terminal projecting from the switch base.

DETAILED DESCRIPTION

Figure 1:
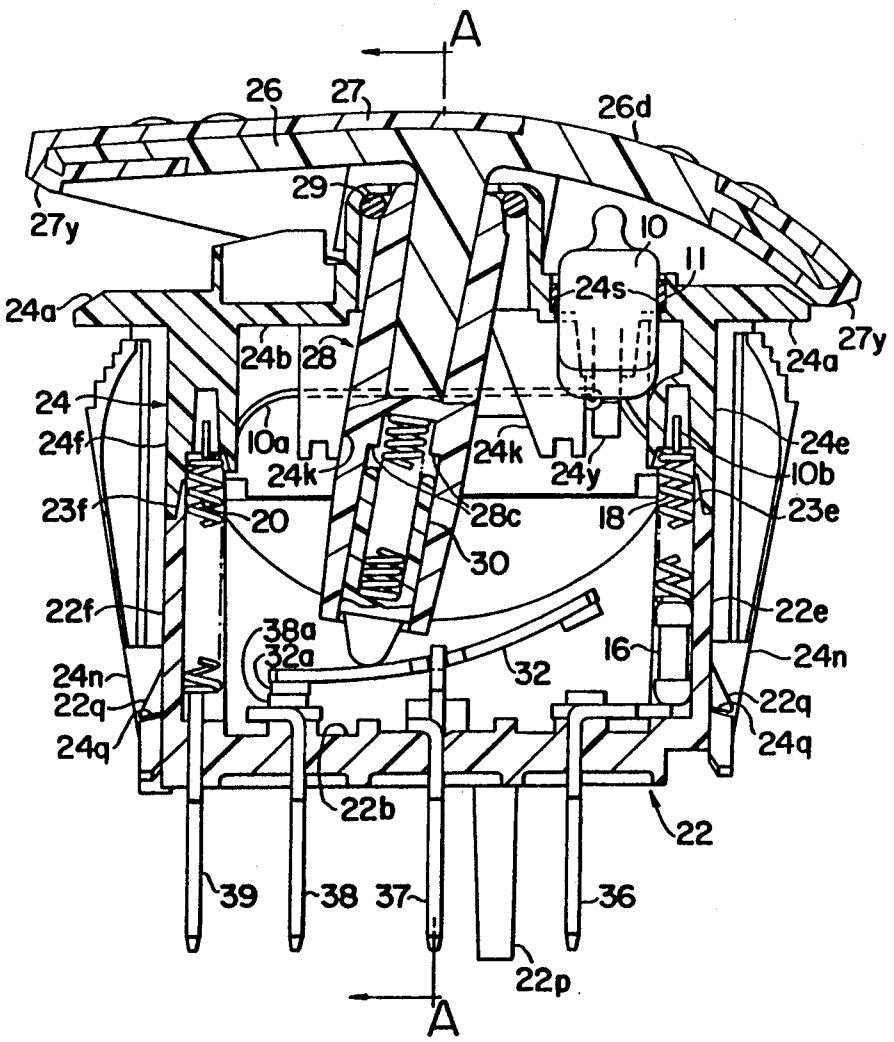
FIG. 1 is a vertical section taken through a switch constructed in accordance with the present invention, the rocker and actuator and movable contact being shown in one position.

Turning now to the drawings in greater detail, FIG. 1 shows an electric switch case constructed in accordance with the present invention, and the invention will be described with reference to the orientation of the switch as depicted in these drawings with the understanding that the terms upwardly and downwardly are relative when interpreting the scope of the claims as presented hereinafter.

The switch shown is equipped with a lamp 10, which lamp has associated conductors 10*a* and 10*b* adapted to be electrically connected respectively to fixed terminals 39 and 36 of the switch. The lamp 10 may be in the form of a neon incandescent, or light-emitting diode (LED).

With the use of an LED or neon lamp a resistor 16 may be provided in the lamp circuit. Coil compression springs such as indicated at 18 and 20 would be provided between the lamp leads 10*a* and 10*b* and the terminals 39 and 36 in order to make contact between the lamp and terminals and allow the option of installing a resistor 16 in the lamp circuit.

The electric switch case or housing comprises an upwardly open base 22 having a bottom wall 22*b* in which openings are provided for various fixed terminals such as 36, 37, 38 and 39. The switch base 22 also includes laterally spaced front and rear walls 22*c* and 22*d*, FIG. 2, and opposed end walls 22*e* and 22*f*, FIG. 1, all of which upstanding walls are integrally connected to one another and to the bottom wall 22*b* so as to define an upwardly open cavity that cooperates with a downwardly open cavity, defined by the mounting bracket 24, to provide an enclosed cavity for the switch components. The mounting bracket 24 includes front and rear walls 24*c* and 24*d* which are adapted to mate with the front and rear walls 22*c* and 22*d*, respectively, of the base 22 as indicated generally at 23*c* and 23*d* in FIG. 2. The mounting bracket 24 also includes end walls 24*e* and 24*f* which mate with the end walls 22*e* and 22*f*, respectively, as indicated generally at 23*e* and 23*f* in FIG. 1. This geometry effectively seals the interior of the switch case cavity from external environmental hazards.

Figure 2:
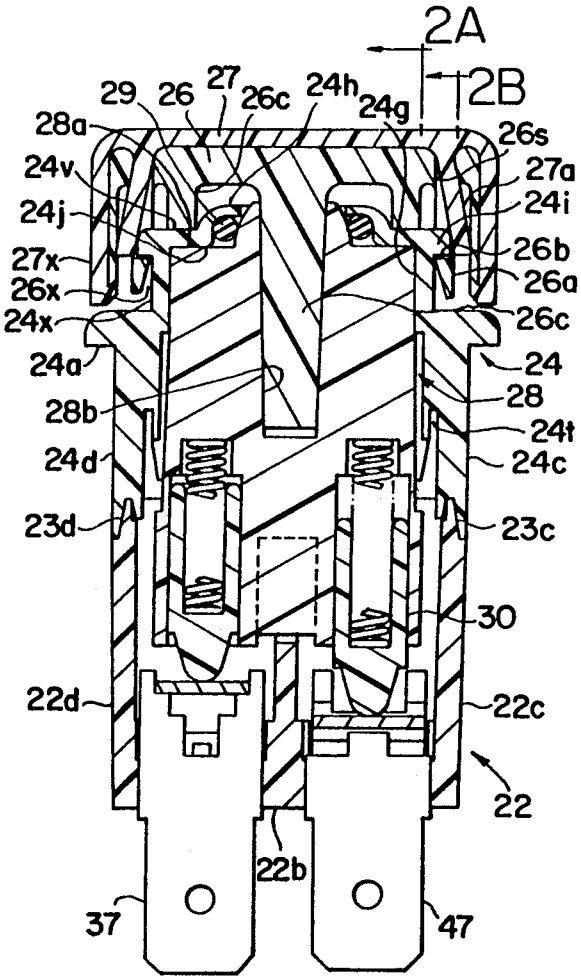
FIG. 2 is a vertical section taken generally on line A—A of FIG. 1, but with the actuator shown in a position intermediate of its two extreme end positions, that is with the plungers aligned with the center fixed contacts of which two different versions are shown.
Figure 3:
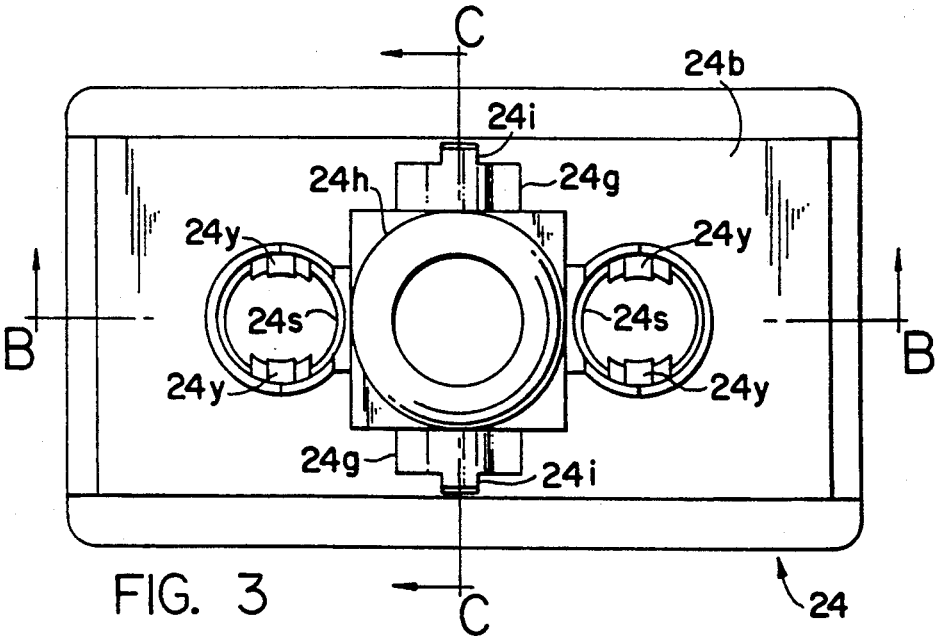
FIG. 3 is a top plan view of the bracket.
Figure 4:
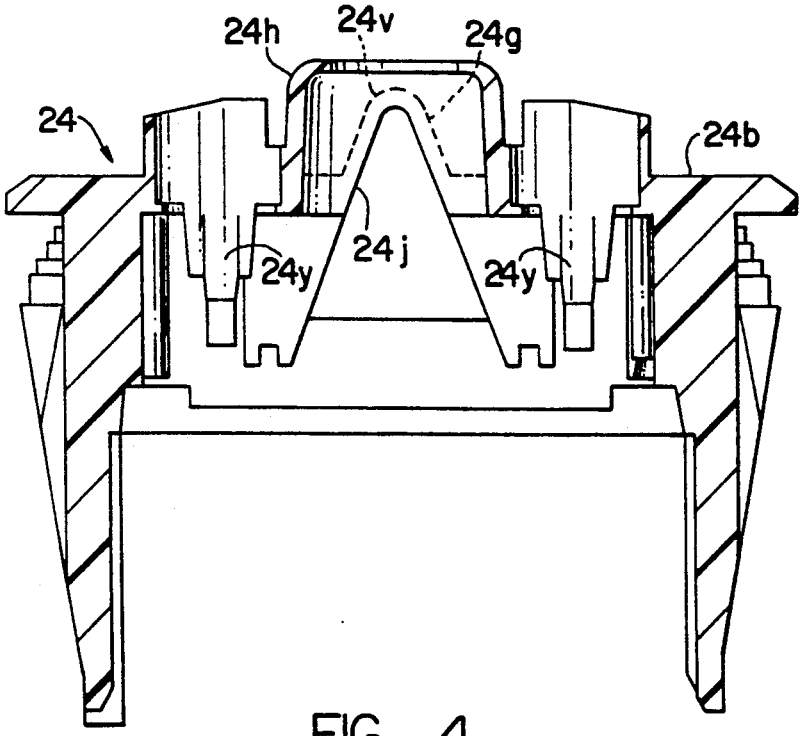
FIG. 4 is a vertical section of the bracket taken generally on the line B—B of FIG. 3.
Figure 2A:
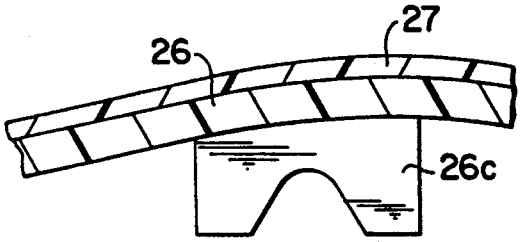
FIGS. 2A and 2B are sectional views through the composite rocker.
Figure 2B:
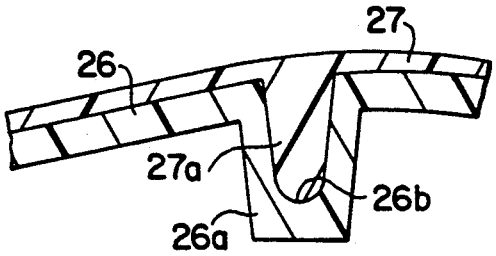

Still with reference to the mounting bracket 24 its top wall 24*b* defines a peripherally extending flange 24*a*, which flange is adapted to engage the outer face of a panel that defines an opening of suitable rectangular shape for receiving the switch case. As best shown in FIG. 3 this top wall surface 24*b* of the mounting bracket 24 has a central laterally extending rib portion 24*g*, illustrated at least in part in FIG. 2 and also shown in FIG. 4. An upstanding boss 24*h* is defined centrally of the top wall 24*b*, and forms the center portion of the rib 24*g*. The ribs 24*g* define inner sockets 24*j*, FIG. 4, that receive shoulder portions 28*a*, FIG. 2, of an actuator 28 provided inside the switch case and adapted to move pivotally between the limit stops 24*k* illustrated in FIG. 1. With reference to FIG. 2, laterally opposed outwardly projecting axle defining posts 24*i* serve to lock into openings created in resilient wall portions 26*a* of the rocker 26.

The rocker is of two part construction 26/27, whereby the first part 26 is molded with resilient wings 26*a*. Slots 26*s*, FIG. 2, in the first part 26 receive depending skirts 27*a* defined by the second part material. These skirts 27*a* extend to the edge 26*b* of the resilient wings 26*a* which engage the bracket posts 24*i*. The first part 26 of the rocker is of a hard plastic and provides the structural form and strength of the rocker, thereby allowing the second overlay material, 27, to be molded of either a soft pliable material or a hard material, as desired. The second overlay material, 27, is molded over the top and side surface of the rocker with the underside of the rocker defined by the first part 26, except for the skirts 27*a* that fills the slots 26*a* through the top surface of the first part, 26, and extend down to the edge 26*b* of the resilient wings 26*a*. This skirt material 27*a* flexes outward with the resilient wings 26*a* as the rocker is forced onto the bracket posts 24*i*, and the wings 26*a* snap back to engage the posts 24*i* with the edges 26*b*. The skirt material 27*a* remains flexed outward. The rocker also includes inner walls 26*c* with an inverted U-shaped bottom edge which provides a stop limit when the rocker is snapped onto bracket posts 24*i*, and which provides a recess to pivot upon the external U-shaped top surface 24*v*, FIGS. 2 and 4, of the ribs 24*g*. These walls 26*c* also prevent damaging downward or twisting pressure exerted upon the rocker from being transmitted to locking posts 24*i*.

Figure 11:
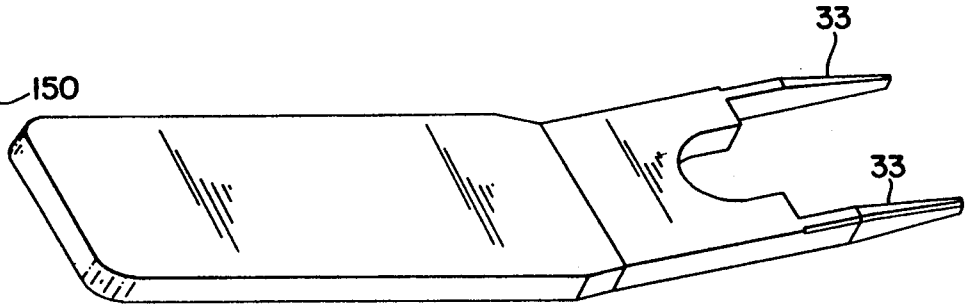
FIG. 11 is a diagonal view of the rocker removal tool.

The rocker may be easily removed from the bracket with the use of a tool with two tapered probes 33, FIG. 11, which would be inserted from either end of the switch, between the rocker 26 and the flange 24*a*, FIG. 1, whereby the pointed ends of the probes would enter the gaps 26*x* between the resilient wings 26*a* and the bracket rib ends 24*x*. As the probes are pushed further into the gaps, the expanding width of the probes causes the wings 26*a* to flex outward, ultimately forcing the surfaces 26*b* to unlatch from the posts 24*i* and the rocker to move upward off the bracket. Due to the angled inner surfaces of the wings 26*a*, the wings 26*a* will be forced upward by the probe as well as outward.

The first part of the rocker may be of translucent or transparent material and the second overly material 27 may be opaque and molded so as to leave a portion of the translucent material uncovered to provide illumination by a lamp located beneath the uncovered area 26*d*, FIG. 1. The actuator 28, FIG. 2, defines a central opening 28*b* which serves to receive a depending post 26*c* of complementary shape provided for it centrally of the rocker 26. As so constructed and arranged the rocker and actuator move together about a laterally extending axis defined by the axle defining posts 24*i* of the mounting bracket top wall rib portion. To further define this axis, the upper edge of the shoulders 28*a* of the actuator cooperate with the sockets 24*j* defined by the mounting bracket so that the actuator always moves on the same axis as that defined for the rocker.

Still with reference to the actuator 28, at least one spring biased plunger 30 is provided in a downwardly open plunger recess or cavity, and the lower end of the plunger engages a movable contact element which is pivotally received in the upper end of the central fixed contact 13 referred to previously. As can best be seen with reference to FIG. 1 movement of the actuator and rocker between the two limit positions defined by the stops 24*k* will normally result in movement of the contact lever 32 to an opposite mirror-image position. If for any reason the contacts 32*a* and 38*a* fail to open as the plunger 30 moves past the intermediate position where it is aligned with the center fixed contact 37, further movement of the actuator and rocker will cause the top of plunger 30 to engage the abutments 28*c* of the actuator, and as a result impede further movement of the actuator. Additional pressure on the rocker can only achieve further movement of the actuator by forcing the contacts to break apart. In normal operation of the switch, these contacts would open without such action. When the switch is actuated the abutment 28*c* and the top of plunger 30 limit the travel of the plunger and thereby would force the contacts open if the contacts have welded in a closed condition due to electrical arcing.

As so constructed and arranged the switch case comprises two half sections, one the lower base which supports the terminals and fixed and movable contacts inside the switch cavity, and the other part comprising a mounting bracket which mates with the base and defines the top wall of the switch case cavity. The geometric fit of the base to the bracket effectively seals the sides of the switch case cavity from external environmental hazards. The central boss 24h of the mounting bracket is so configured as to receive means connecting or coupling the rocker to the actuator. Such means preferably comprises a raised center portion of the actuator that in turn defines a central opening 28b for receiving the depending post 26c on the rocker. An O-ring 29 is preferably provided in the gap between the boss on the center portion of the mounting bracket top wall and the raised portion of the actuator as best shown in FIGS. 1 and 2. The post 26c on the rocker is of a lesser diameter that the opening 28b in the actuator to allow an amount of non-binding movement of the post into and out of the opening 28b. This clearance allows pivoting movement to be transferred from the rocker to the actuator, yet prevents the transfer of pressure which may force the actuator into the switch housing and compromise the seal provided by the spring biased plunger 30 exerting pressure through the raised center portion of the actuator and compressing the O-ring 29 against the bracket boss 24h. The upper edge of the shoulders 28a of the actuator cooperate with the angled sockets 24j of the mounting bracket so that the space provided for the O-ring seal is maintained constant during actuation, thereby allowing consistent compression of the O-ring, maximizing the sealing effectiveness and minimizing wear of the O-ring. The actuator shoulders 28a engagement with the angled sockets 24j provide stability to the actuator when only one spring biased plunger 30 is employed.

Figure 5:
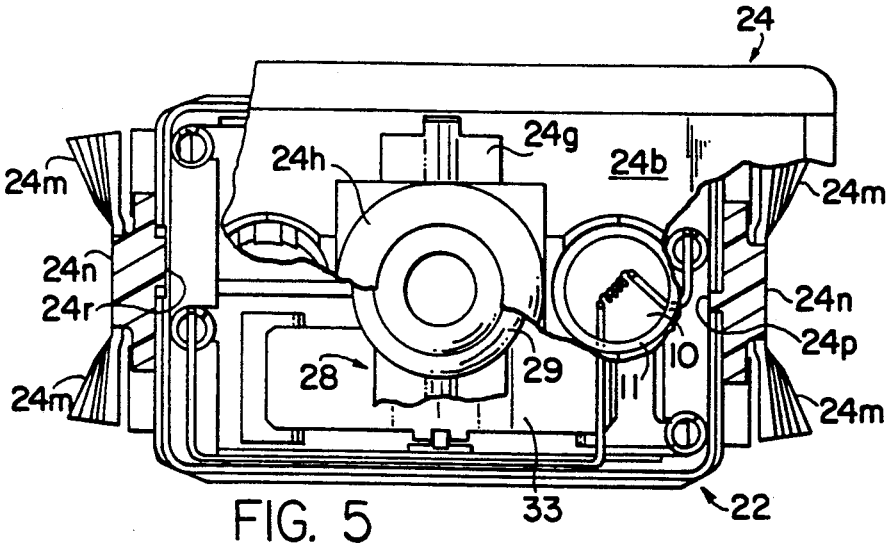
FIG. 5 is a top plan view of the bracket with a cutaway sectioning of the bracket top surface to reveal details of the bracket struts and mounting wings.

Still with reference to the mounting bracket 24, FIG. 5, each end wall 24e and 24f defines a central strut 24n, which strut has laterally outwardly projecting wings 24m that have stepped ridges for cooperating with the underside of the mounting panel opening edge to secure the switch case in the mounting panel. These struts 24n are designed to permit assembly of the mounting bracket to the switch case in only one orientation. This result is achieved by providing ribs 24p and 24r of different size on these struts 24n. The ribs 24p and 24, respectively, are adapted to be received only in appropriately sized slots of corresponding geometry in the end walls 22e and 22f of the switch case base 22.

Figure 6:
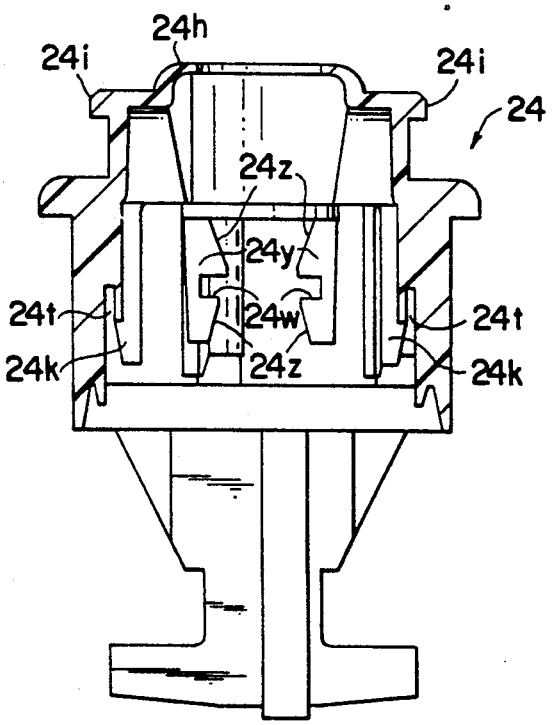
FIG. 6 is a vertical section of the bracket taken generally on the line C—C of FIG. 3.
Figure 8:
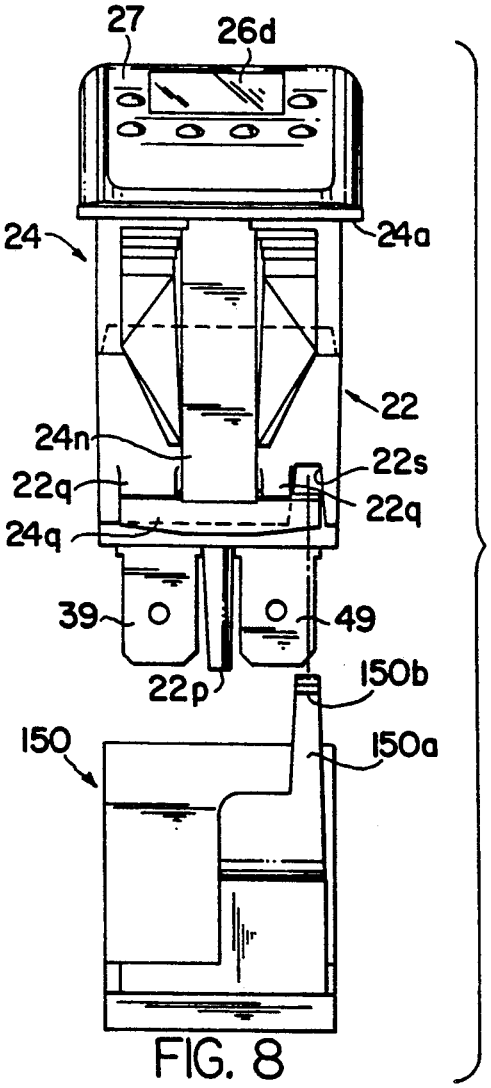
FIG. 8 is an end view of the switch illustrating the attachment of the connector plug to the switch base.

Again with reference to the mounting bracket 24, and as best shown in FIGS. 1, 2, and 6, the front and rear walls 24c and 24d respectively have inner surfaces which include inwardly projecting portions 24k which serve as stops for pivotal movement of the actuator, and which also serve to cooperate with the walls 24c and 24d to define downwardly open slots 24t that are adapted to receive a lead line 10a of the lamp 10 and to prevent the lead line 10a from interfering with the motion of the actuator 28 in the switch case as described above.

The lamp 10 is conveniently mounted in the mounting bracket 24 as referred to previously, and two circumaxially spaced feet 24y, FIGS. 1 and 3, support the lamp 10 in a position where light from the lamp can emanate through a transparent window portion 26d defined for this purpose in the rocker 26/27. The external configuration of the rocker 26/27 is preferably such that its ends 27y are adapted to extend over the flange 24a of the mounting bracket. As shown in FIG. 2, the rocker has outer skirts 27x that are not used to pivotally support the rocker and therefor do not have the usual openings provided in prior art rockers for this purpose. The rocker as so designed provides a low profile, clean design above a mounting panel while shielding the O-ring actuator seal and, if employed, the O-ring lamp seal(s) from top surface environmental elements.

The area between the lamp and the bracket would be preferably sealed with an O-ring 11, FIG. 1. The O-ring would be inserted from above the lamp and compress into the area between the lamp and bracket with a stop provided by the ledge 24s. The switch may be provided with two lamps as allowed for in the bracket in FIG. 3, or with one lamp as shown in FIG. 1 with the second lamp area molded closed, or with no lamp in which case both lamp areas would be molded closed.

The lamp mounting arrangement is designed to receive either neon, incandescent, or LED type lamps. The diametrically opposed depending leg portions 24y, FIGS. 3, 4, and of the bracket are adapted to flex outwardly to maintain pressure against and hold in place a neon or incandescent bulb. The legs 24y, FIG. 6, have notches 24w configured to snap over the bottom circumferential ridge of a light-emitting-diode, LED, and lock such a diode securely in place when used as a lamp. The feet have angled edges 24z at top and bottom to allow insertion of a lamp from either direction.

Turning next to a detailed discussion of the connector plug 150, FIGS. 7, 8, 9, and 10, this component of the assembly is held i place by means of an upwardly extending resilient arm 150a having a free end portion defining a latching edge 150b that is adapted to be received in a suitable notch 22s defined for this purpose in the switch case base 22. The latching edge 150b snaps over an edge 24q of the bracket extending from the struts 24h. The extension edges 24q from the struts 24n also provide a surface which latches against protrusions 22q of the base 22, thereby securing the bracket in the base.

Figure 7:
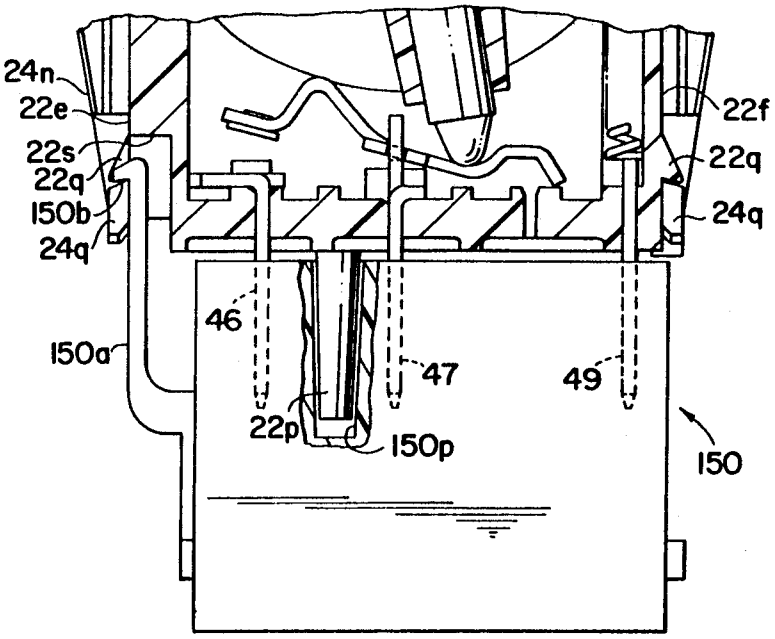
FIG. 7 is a vertical section though an alternative switch illustrating a connector plug attached to the bottom of the switch base.
Figure 9:
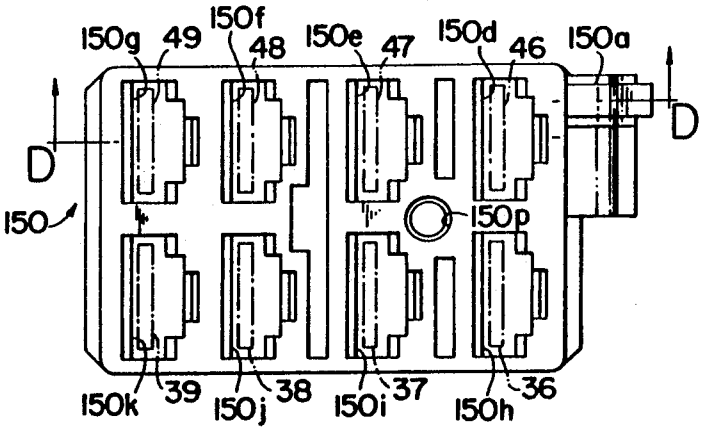
FIG. 9 is a top plan view of the connector plug.

The connector plug 150 also defines an upwardly open bore 150p, FIGS. 7 and 9, for receiving a locating pin 22p defined for this purpose in the bottom wall of the switch case 22. The plug 150 serves to electrically connect any depending terminals such as 46, 47, and 49, FIG. 7, to conductive female terminals (not shown) provided in the plug itself.

Figure 10:
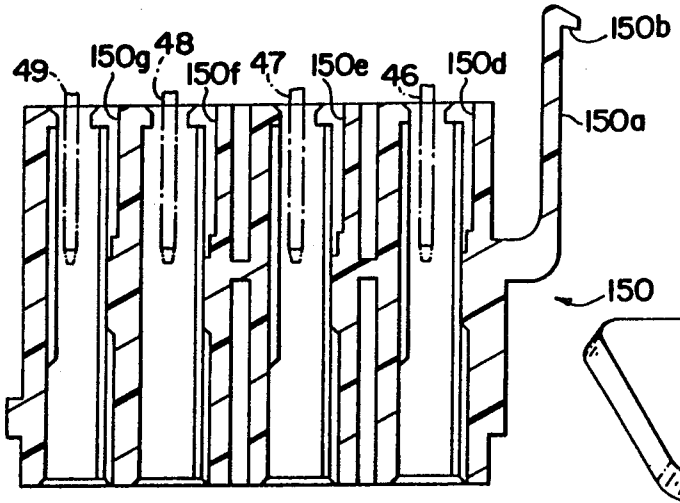
FIG. 10 is a vertical section through the connector generally on the line D—D of FIG. 9.

As best shown in FIGS. 9 and 10, the plug 150 has relatively large openings or receptacles 150d–150g. These openings are designed to receive a variety of conventional spring type female connectors which lock within the connector plug after being secured to the end of a conductive wire. These female connectors are adapted to be received in the cavities 150d, 150e, 150f, 150g, 150h, 150i, 150k, FIG. 9, in such a way to accept terminals extending from the switch base, such as terminals 46, 47, and 49. Once the female connectors have been inserted into the receptacles provided for them in the plug 150, they become locked securely in place as a result of the shape of these receptacles and a barb commonly furnished on this type of female connector.

FIG. 9 shows the plug 150 in top plan view with the switch's optional spade terminals 46 through 49, and 36 through 39 being illustrated in broken lines. The female connectors or terminal ends are not shown in the views FIGS. 9 and 10 because they are of conventional configuration and of standard size for a particular size spade terminal of the type illustrated as 37 and 47, on the switch case base of FIG. 2.

It will be apparent that the movable contact shown in FIG. 7 is different from that illustrated in FIG. 1. As indicated previously with reference to the description of FIG. 2, these differently configured movable contacts are adapted to be supported on differently configured center fixed contacts. It will be apparent that a typical double pole switch may include identical movable contacts and center fixed contacts of either of the two varieties illustrated in the drawings.

We claim:

1. An electric switch comprising an upwardly open switch case having a base with a bottom wall in which openings are provided for terminals, said base having laterally spaced front and rear walls and opposed end walls integrally connected to said bottom wall and to each other to define an upwardly open cavity, at least one movable contact provided in said switch cavity, said case also including a mounting bracket having a top wall and laterally spaced front and rear walls adapted to mate with said front and rear walls of said base respectively, said bracket having opposed end walls integrally connected to said front and rear walls thereof to define a downwardly open cavity that communicates with the cavity in said base to define an enclosed switch cavity, said bracket top wall defining a raised center rib portion which has laterally spaced sockets, an actuator having upper shoulder portions received in said sockets, at least one spring biased plunger slidably received in a downwardly open plunger cavity defined by said actuator for engaging said one movable contact to pivot said one movable contact in response to actuator pivotal movement on a laterally extending axis defined by said actuator shoulders and said laterally spaced sockets, and a pivoted member above said mounting bracket top wall and having a depending central post received in an upwardly open recess provided for said post in said actuator, said mounting bracket having laterally spaced pivot posts provided at opposite ends of said central rib at said laterally extending actuator pivot axis, and said pivoted member having resilient wings spaced laterally from said central posts, said pivot posts being received in openings provided for them in said pivoted member wings, and an O-ring seal provided in said central opening of said mounting bracket rib portion.

2. The combination according to claim 1 further characterized by fixed contacts in said bottom wall, said one movable contact supported on one of said fixed contacts for pivotal movement between limit positions wherein a free end of said movable contact abuts another of said fixed contacts, said one fixed contact provided below said laterally spaced sockets, the combined length of said actuator and plunger being a predetermined minimum equal to or slightly less than the distance from said socket to said one movable contact when said plunger is aligned with said one fixed contact, said one fixed contact defining a fulcrum for said movable contact so that said free end is positively moved away from said another fixed contact as a result of said plunger and actuator minimum length geometry to provide for forcible separation of the contacts as said actuator is pivoted away from said one fixed contact.

3. The combination according to claim 1 wherein said pivoted member has outer depending skirts spaced laterally inwardly of said wings defining said pivot openings.

4. The combination according to claim 3 wherein said pivoted member further includes depending abutment walls spaced inwardly of said pivot opening defining wings, said abutment walls having a contour that matches that of said laterally extending central rib of said mounting bracket to provide further pivotal support for said pivoted member.

5. The combination according to claim 3 further characterized by a pivoted member removal tool, said tool having a bifurcated end to fit between said pivoted member wings and said bracket top wall, said tool and said wings being so shaped that said tool is effective to flex said wings laterally outwardly as said pivoted member is urged away from said bracket by said tool.

6. The combination according to claim 1 further characterized by a lamp supported in a lamp opening defined by said mounting bracket top wall, fixed contacts in said bottom wall, said movable contact supported on one of said fixed contacts for pivotal movement between limit positions wherein a free end of said movable contact abuts another of said fixed contacts, at least one of said laterally spaced front and rear walls of said mounting bracket defining a downwardly open slot, and said lamp having two leads, one of said two leads being received in said slot, and means connecting said one lead to one of said fixed contact and located in part in an end wall of said switch case that is remote from the location of said lamp in said top wall.

7. The combination according to claim 6 wherein said means connecting said one lead to said fixed contact further comprises a coil spring provided in a spring cavity defined in part by one end wall of said switch case base and in part by one end wall of said mounting bracket.

8. The combination according to claim 7 wherein each of said mounting bracket end walls further includes a depending strut adapted to be received in a slot provided by an outside surface of said base end wall and integrally formed wings projecting laterally outwardly of said strut, said mounting bracket defining a flange that is adapted to abut one mounting panel surface as said wings abut the edges of the panel opening in which the switch is mounted.

9. The combination according to claim 7 wherein each said base end walls define slots, said slots being of different width, and ribs defined on said struts to fit into said slots in only one orientation of said mounting bracket relative to said base.

10. The combination according to claim 6 further including a connector plug adapted to be removably received on the bottom of the switch base.

11. The combination according to claim 10 wherein said connector plug has a resiliently deformable arm said switch base defines a cavity for receiving said connector plug arm.

12. The combination according to claim 11 wherein said switch base has a depending post said connector plug defining a locating hole for receiving said depending post on said switch base.

13. The combination according to claim 12 wherein said connector plug defines through openings for receiving female cable end connectors adapted to mate with the terminals provided in the switch base.

14. The combination according to claim 1 further including a connector plug adapted to be removably received on the bottom of the switch base.

15. The combination according to claim 14 wherein said connector plug has a resiliently deformable arm said switch base defines a cavity for receiving said connector plug arm.

16. The combination according to claim 15 wherein said switch base has a depending post, said connector plug defining a locating hole for receiving said depending post on said switch base.

17. The combination according to claim 16 wherein said connector plug defines through openings for receiving female cable end connectors adapted to mate with the terminals provided in the switch base.

18. The combination according to claim 1 further characterized by a lamp, a lamp opening defined by said mounting bracket top wall for receiving said lamp, said top wall defining at least two depending resilient lamp receiving legs, said legs being adapted to receive said lamp, and annular sealing means surrounding said lamp.

19. The combination according to claim 18 wherein said lamp receiving legs are designed to receive and to secure a lamp from below and also from above.

* * * * *